US007850157B2

(12) United States Patent
Giro Amigo

(10) Patent No.: US 7,850,157 B2
(45) Date of Patent: Dec. 14, 2010

(54) METHOD FOR THE MOVEMENT OF SUPERIMPOSED BANDS OF FLEXIBLE MATERIAL

(75) Inventor: Ezequiel Giro Amigo, Badalona (ES)

(73) Assignee: Girnet Internacional, S.L., Badalona (ES)

( * ) Notice: Subject to any disclaimer, the term of this patent is extended or adjusted under 35 U.S.C. 154(b) by 972 days.

(21) Appl. No.: 11/179,644

(22) Filed: Jul. 13, 2005

(65) Prior Publication Data

US 2006/0032884 A1 Feb. 16, 2006

(30) Foreign Application Priority Data

Aug. 11, 2004 (ES) ..... 200402008

(51) Int. Cl.
*B65H 23/188* (2006.01)

(52) U.S. Cl. ..... 270/52.08; 226/2; 226/111

(58) Field of Classification Search ..... 226/111, 226/112, 178, 152, 2; 270/52.08; 271/202, 271/91, 93, 114
See application file for complete search history.

(56) References Cited

U.S. PATENT DOCUMENTS 2,641,416 A * 6/1953 McCleary et al. ..... 242/563.1
2,821,383 A * 1/1958 Ludwig ..... 270/52.08
3,556,509 A * 1/1971 Crum ..... 270/52.08
3,701,299 A * 10/1972 Stumpf ..... 83/72
4,179,107 A * 12/1979 Harris ..... 270/4
4,179,109 A * 12/1979 Harris ..... 270/52.08
4,361,318 A * 11/1982 Stobb ..... 271/202
4,373,713 A * 2/1983 Loebach ..... 271/303
4,944,620 A * 7/1990 Scozzafava et al. ..... 400/608.1
5,019,203 A * 5/1991 Singer ..... 156/309.9
5,184,788 A * 2/1993 Schenk et al. ..... 242/541.2
5,362,013 A * 11/1994 Gietman et al. ..... 242/521
5,604,992 A * 2/1997 Robinson ..... 34/90
5,689,795 A * 11/1997 Mastrandrea ..... 399/407
6,394,445 B1 * 5/2002 d'Agrella et al. ..... 271/182
6,409,043 B1 * 6/2002 Fujita et al. ..... 271/10.03
6,412,771 B1 * 7/2002 Hirata et al. ..... 271/116
2008/0116087 A1 * 5/2008 Hathaway ..... 206/223

* cited by examiner

*Primary Examiner*—Michael R Mansen
*Assistant Examiner*—Scott Haugland
(74) *Attorney, Agent, or Firm*—Sughrue Mion, PLLC

(57) ABSTRACT

Method for the movement by friction of a set of two bands of superimposed flexible material, using at least two feed rollers that turn in the direction of band movement so that they are all pulled in unison, occasionally involuntary offsetting can occur in the mutual correct position of the bands, the method includes the placing of antifriction devices between both adjacent bands that allow mutual movement between both bands when they are pressurised between the opposite rollers and are pulled by them, without slipping between the bands and rollers, and because on at least one operative cycle the method includes an adjustment stage wherein the two rollers have a tangentially different speed so that one of the bands is pulled to a greater distance than the other, in order to correct the aforesaid involuntary offsetting in the mutual position between both bands.

11 Claims, 1 Drawing Sheet

METHOD FOR THE MOVEMENT OF SUPERIMPOSED BANDS OF FLEXIBLE MATERIAL

TECHNICAL FIELD OF THE INVENTION

The invention relates to a method for the continuous or intermittent movement by friction of a set of two bands of superimposed flexible material, using at least two feed rollers arranged tangentially opposite at both sides of said set of bands, which can be turned in opposite directions and in the direction of movement of the bands.

BACKGROUND OF THE INVENTION

Traction on a band of flexible material through feed rollers is used in many manufacturing processes wherein the same operation has to be carried out repeatedly or continuously along a band length, or in processes wherein different operations must be carried out sequentially on the same part of a band. In the first case, the band has to pass between the two turning feed rollers that turn in opposite directions and at the same speed in such a way that they pull the band making it move forward continuously by friction and pass, tautly, through the station wherein the operation is carried out, generally located upstream with respect to the rollers. In the second case, the operations take place in various fixed stations, arranged one after the other in the direction of band movement and which act on the aforesaid at the same time as it is forced to move.

In the cases wherein there are two superimposed bands which are pulled, and especially in the cases wherein the bands are stored on reels which unwind when pulled from a free end, due to the differences in forces that the rollers have to tolerate when pulling each one of the bands, and depending on the length of the band still stored on the reel, one of the bands is pulled a greater distance than the other.

Normally these bands have informational or advertising messages printed on them that occupy a certain length on the band and are repeated various times on the reel. The idea is that they are cut during the production process so that each message is finally presented individually, i.e. a single section. Nevertheless, due to the flexibility in plastic sheet production by varying said conditions (raw material, temperature, humidity, stress, etc. . .), small differences in the length of the printed message between one band and another occur. This can and does happen even on the same reel whereby the length of the section of printed message in the initial meters of the reel is not the same as in the central or final meters.

This difference in movement or including dimensions of the printed message on the bands can accumulate as the band moves, which means that along a large length of bands it can cause defects in the finish of the end product, especially in the cases of identical operations that are carried out on the two bands and in those that the bands are paired together after carrying out the aforesaid operations.

When producing mesh bags, heat-sealable material sheets, placed facing each other on each side of a tubular mesh are used to fuse the ends of the bag and thereby form the bottom and seal thereof after being filled. To produce these types of bags, the tubular mesh and the attached sheets have to pass through two feed rollers to carry out the soldering and cutting operations, on the set formed by the mesh and the sheets in order to form the bags.

But the sheets also serve to print identification data on the bag about its content or for advertising. Therefore in the event that there is matching or corresponding information on the sheets adjacent to the two faces of the tubular mesh, there is the possibility that this information does not correspond, once the bag has been finished due to the fact that one sheet has been pulled by the rollers to a different length than the other.

If the two sheets are not lined up it could give rise to other serious consequences that could cause bag production to stop, for example when the sheets have different colours printed on them for the base or for better closing, or if the sheets have markers incorporated designed to be detected by optical readers or any device on the machine.

In any case, due to the fact that progressively and as the rollers pull the tubular mesh to produce one bag after another, the differences in movement between the sheets increase, until such a point that it is necessary to stop the machine to manually line up the two sheets designed to form the two faces of the same bag to avoid the problems stated above.

EXPLANATION OF THE INVENTION

The method for continuous or intermittent movement of a set of two superimposed bands object of the invention, allow the unequal movement to be corrected, i.e. the involuntary offset of the correct mutual position of the bands, without interrupting the process that is being carried out. The method is particularly aimed at those installations wherein the joint movement of the two bands of superimposed flexible material, is carried out by friction on at least one of the feed rollers placed tangentially opposite at both sides of the aforesaid set of bands and that turn in the direction of the movement of the bands.

In essence, the method is characterized in that between both adjacent bands of the set of bands there are two antifriction devices that allow mutual movement between both bands when they are pressurised between the opposite rollers and are pulled by them, without appreciable slipping between the bands and the rollers, and because in at least one operative cycle the method includes an adjustment stage, wherein one of the bands is pulled a larger distance than the other bands by the respective rollers, with the aim of correcting the aforesaid involuntary offset in mutual position between both bands.

In an ideal production, the two rollers have different tangential speeds in the adjustment stage. Also, it is possible for the two rollers to work in opposite directions to compensate at a given moment for the adjustment differences between both bands.

According to the other characteristic of the invention, the antifriction means are comprised of a plastic material band and, surprisingly in the ideal operation the antifriction methods are made up of a mesh material, therefore the method is applicable in the field of mesh bags production, wherein two heat-sealable sheets are fixed opposite each other at each sides of a tubular mesh for their continuous production. Thus, the same mesh carries out the functions of an antifriction device, therefore it is not necessary to provide any other product to carry out the invention method.

BRIEF DESCRIPTION OF THE DRAWINGS

The attached drawings illustrate, schematically, various sequences resulting from carrying out the invention method. In the aforesaid drawings.

DETAILED DESCRIPTION OF THE DRAWINGS

Figure 1:
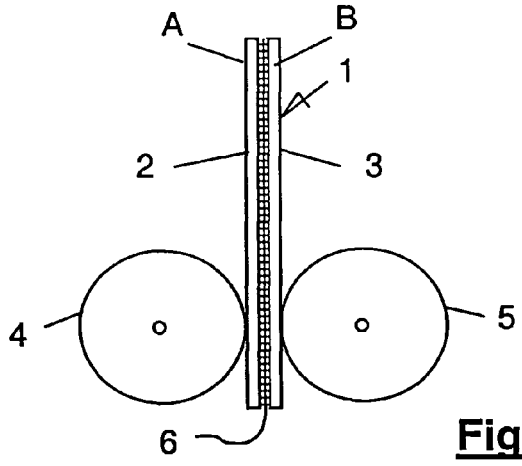
FIG. 1, illustrates a set of two superimposed bands, between which there is a mesh material in the start position.

The attached drawings represent a set (1) formed by two bands (2 and 3 respectively), of flexible material, attached opposite each other and in points to a tubular mesh material (6). Set 1 is pulled through two feed rollers (4 and 5), placed tangentially opposite each sides of the aforesaid set 1 of bands and tubular mesh, and it is especially designed for the production of mesh bags.

In the original position of FIG. 1, markers A and B on bands 2 and 3 respectively, are matched, at the same distance from feed rollers 4 and 5. Markers A and B simulate, for example, designs printed repeatedly along sheets 2 and 3, and are designed to incorporate production information, consumer information, provide the sheets with advertising information or to activate downstream mechanisms on rollers 4 and 5 in a bag making machine.

Figure 2:
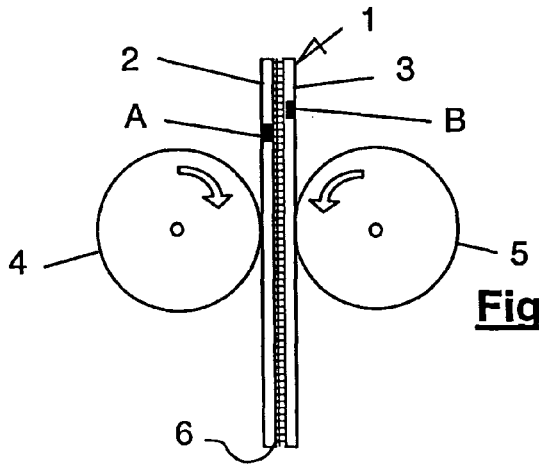
FIG. 2, illustrates the same set of bands after pulling has started using the two turning rollers, and in such a way that one band has been pulled to a greater distance than the other.

As feed rollers 4 and 5 turn at the same speed in the direction of movement of set 1, involuntary offsetting of the correct mutual position between bands 2 and 3 is produced, that build up whilst set 1 is pulled. This reflex situation in FIG. 2, wherein markers A and B of bands 2 and 3, respectively, stop being paired out due to the fact that band 2 has been pulled to a larger distance than band 3 or because after advancing various meters on the bands and passing markers A and B various times, due to flexibility in band production, there are differences in lengths between successive markers A and B. This situation must be corrected due to the fact that if the information at markers A and B complements each other or if said markers A and B activate mechanisms downstream from rollers 4 and 5, the offset between bands 2 and 3 can lead to defective bags or later mistakes in the machinery used in the production of said bags.

The placing of antifriction devices between bands 2 and 3 and through a selective action on rollers 4 and 5, it is possible to correct the involuntary offsets that occur during the pulling of the bands without need to detain the movement of set 1.

In the example of the drawings, the same tubular mesh 6 carries out the functions of the antifriction devices, thereby allowing the mutual feeding between bands 2 and 3 when they are placed between feed rollers 4 and 5 and are pulled by them without noticeable movement between the bands and the respective rollers. To achieve this, during a period of time, feed rollers 4 and 5 are provided with a different tangential velocity (including in the opposite direction) in a pulling cycle every certain number of cycles or in every one of the pulling cycles, depending on the severity of the involuntary offsetting to be corrected.

Figure 3A:
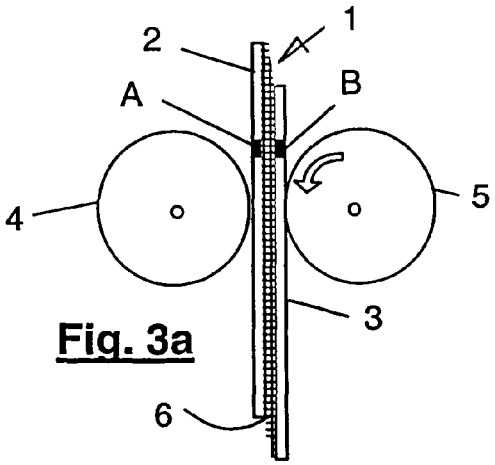
FIG. 3*a*, illustrates the same set of bands, with the offset in the mutual movement of the bands represented in FIG. 2 corrected, according to a first variant in the invention method.
Figure 3B:
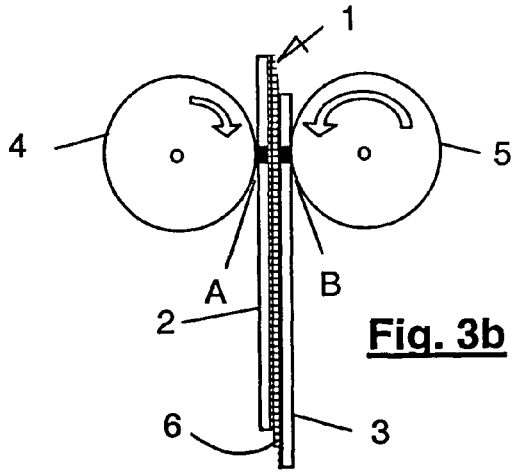
FIG. 3*b*, illustrates the same set of bands, with the offset in the mutual movement of the bands represented in FIG. 2 corrected, according to a second variant in the invention method.

The adjustment can be carried out in various ways; two examples have been represented in FIGS. 3*a* and 3*b* respectively. In FIG. 3*a*, the pulling roller 4 of band 2 is stopped for an instant, so that pulling roller 5 of band 3 continues to turn pulling in its movement band 3, which moves with respect to its opposite band 2 through tubular mesh 6, that acts as an antifriction medium. Band 3 moves sufficiently until its corresponding marker B reaches the pairing position with marker A on band 2.

In FIG. 3*b*, the turning of pulling roller 4 does not stop and band 2 keeps going. Nevertheless, if the pulling roller 5 is speeded up in comparison to pulling roller 4, the increased tangential velocity on its surface obliges band 3 to increase to a greater distance than band 2, until which point marker B matches with marker A on the aforesaid band 2. Naturally, the result is the same if the turning speed is reduced for the pulling roller 4 if the turning speed of pulling roller 5 is maintained, only being necessary if the tangential velocity of pulling roller 5 is greater than that of matching pulling roller 4.

The invention claimed is:

1. Method for the continuous or intermittent movement by friction of two bands of superimposed flexible material comprising:

providing at least two pulling rollers, placed tangentially at both sides of said two bands, to pressurize the two bands as the two bands pass between the pulling rollers and thereby pull the two bands;

pulling the two bands in a same direction with the pulling rollers;

providing an antifriction device disposed between the two bands that allow respective movement between the two bands;

adjusting the alignment of the two bands when involuntary offsets occur between the two bands by pulling one of the bands a greater distance than the other band, or pulling one of the bands in a direction opposite to the direction that the other band is being pulled, without slippage between each band and a corresponding one of pulling rollers that contacts the band;

the adjusting step is performed by temporarily driving the two pulling rollers at different tangential velocities with respect to each other until the two bands are in alignment; and after the adjusting step, driving the two pulling rollers at same tangential velocities with respect to each other.

2. Method for the continuous or intermittent movement of the two bands according to claim 1, wherein the antifriction device comprises a band of plastic material.

3. Method for the continuous or intermittent movement of the two bands according to claim 1, wherein the antifriction device comprises a mesh material.

4. Method for the continuous or intermittent movement of the two bands according to claim 1, wherein the two bands are pulled together in unison when the two pulling rollers rotate in opposite directions at the same tangential speed.

5. Method for the continuous or intermittent movement of the two bands according to claim 1, wherein the two bands are adjusted by the two pulling rollers rotating in the same direction such that the two bands are moved in opposite directions.

6. Method for the continuous or intermittent movement of the two bands according to claim 1, wherein the two bands comprise heat-sealable material.

7. Method for the continuous or intermittent movement of the two bands according to claim 1, wherein the two bands are used to produce a mesh bag.

8. Method for the continuous or intermittent movement of the two bands according to claim 1, wherein the antifriction device comprises a tubular mesh material suitable for producing mesh bags.

9. Method for the continuous or intermittent movement of the two bands according to claim 1, wherein each of the two bands is pressurized by the two pulling rollers during the adjusting step.

10. Method for the continuous or intermittent movement of the two bands according to claim 1, wherein the antifriction device allows respective movement between portions of the bands that are pressurized by the two pulling rollers when the two pulling rollers rotate at different tangential speeds.

11. Method for the continuous or intermittent movement of the two bands according to claim 1, wherein a material of the antifriction device is different than a material of the two bands.

* * * * *